US005655934A

United States Patent [19]

Gow et al.

[11] Patent Number: 5,655,934

[45] Date of Patent: Aug. 12, 1997

[54] ELECTRICAL PLUG CONNECTOR

[75] Inventors: Neil Gow, Brownshill Cottage; Robert Pantland, Gloucester, both of United Kingdom

[73] Assignee: Krone AG, Berlin-Zehlendorf, Germany

[21] Appl. No.: 499,068

[22] Filed: Jul. 6, 1995

[30] Foreign Application Priority Data

Jul. 21, 1994 [DE] Germany ..... 44 25 748.1

[51] Int. Cl.[6] ..... H01R 23/02

[52] U.S. Cl. ..... 439/676; 439/344

[58] Field of Search ..... 439/676, 344, 439/395, 404

[56] References Cited

U.S. PATENT DOCUMENTS

| | | | |
|---|---|---|---|
| 4,641,901 | 2/1987 | Brennan et al. | 439/344 |
| 5,074,804 | 12/1991 | Pantland . | |
| 5,248,267 | 9/1993 | Weng | 439/676 |

FOREIGN PATENT DOCUMENTS

| | | | |
|---|---|---|---|
| 0080772 | 6/1983 | European Pat. Off. | 439/676 |
| 2169156 | 7/1986 | United Kingdom | 439/676 |

*Primary Examiner*—David L. Pirlot
*Assistant Examiner*—Tho D. Ta
*Attorney, Agent, or Firm*—McGlew & Tuttle

[57] ABSTRACT

An electrical plug connector, including an upper housing portion 1, a lower housing portion 2 and a plug chamber 4 for a RJ plug. In the upper housing portion 3 contact elements to be wired with connecting wires are disposed. The inner ends of the connecting wires are connected with contact strips 7 projecting into the plug chamber 4 for contacting the RJ plugs. The plug chamber 4 is adapted as a separate housing portion 3 and is latchable with the lower housing portion 2 by connection elements 16, 17, 18, in at least two different positions. The contact strips 7 are bent off each in different directions into the plug chamber 4, depending upon the position of the plug chamber 4.

5 Claims, 4 Drawing Sheets

ELECTRICAL PLUG CONNECTOR

FIELD OF THE INVENTION

The invention relates to an electrical plug connector, comprising an upper housing portion, a lower housing portion and a plug chamber for a RJ plug. Contact elements are disposed in the upper housing portion. The contact elements are wired with connecting wires. The inner ends of the connecting wires are connected with contact strips projecting into the plug chamber for contacting the RJ plugs.

BACKGROUND OF THE INVENTION

An electrical plug connector of the type referred to herein is known in the art from EP 0 445 376 A1. The disclosed connector has a lower housing portion and a plug chamber which are adapted as one piece. The lower housing portion including a flat end section onto which there is latched the upper housing portion, and the plug chamber is disposed beside the upper housing portion. The plug chamber is only accessible from that side of the electrical plug connector which is opposite to the side opposite to the contact elements to be wired with the connecting wires. Further, by the arrangement of the plug chamber on a front side of the upper housing portion, the length of the complete plug connector is regularly identical to the length of the upper housing portion plus the length of the plug chamber.

SUMMARY AND OBJECTS OF THE INVENTION

It is therefore the object of the invention to improve the electrical plug connector of the type referred to herein with respect to the plugging possibilities of a RJ plug and with respect to the spatial arrangement of the plug chamber relative to the upper housing portion.

It is the further object of the invention to provide a connector including insulation displacement contacts and RJ receiving contacts for connecting insulated wires to wires connecting to an RJ plug wherein the disposition of the insert direction into the insulation displacement contacts and the insert direction of the RJ plug may be changed to provide various possibilities. These objects are attained by adapting the plug chamber as a separate housing portion which is latchable with the lower housing portion by means of connection elements in at least two different positions, the contact strips being bent off each in different directions into the plug chamber. Thereby it is achieved, on the one hand, that the plug chamber can be fitted with a RJ plug from different plugging directions, depending on the arrangement relative to the upper housing portion, and that on the other hand the length of the electrical plug connector in any application is not larger than the length of the upper housing portion.

The plug chamber portion can be latched, namely, in a position, e.g., on the front side of the upper housing portion, where the plug chamber is arranged at a right angle to the wiring side of the upper housing portion. The plug chamber can also be latched with the upper housing portion on the rear side of the plug connector, the plug chamber being located on the side of the upper housing portion opposite to the wiring side. The provision of the plug chamber as a separate housing portion allows thus a multiplicity of variations of the spatial arrangement of the plug connector and simultaneously provides a multiplicity of plugging directions for the RJ plugs.

In another embodiment of the present invention, the connection elements are formed of guide webs at the lower and upper housing portions and of guide grooves at the plug chamber portion. Thereby, the plug chamber portion can be latched with its guide grooves either onto the guide webs at the front side of the upper housing portion or onto the guide webs on the rear side of the lower housing portion, thus an insertion capability of the RJ plug from the forward front side or the rear side, respectively, becoming possible.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 2:
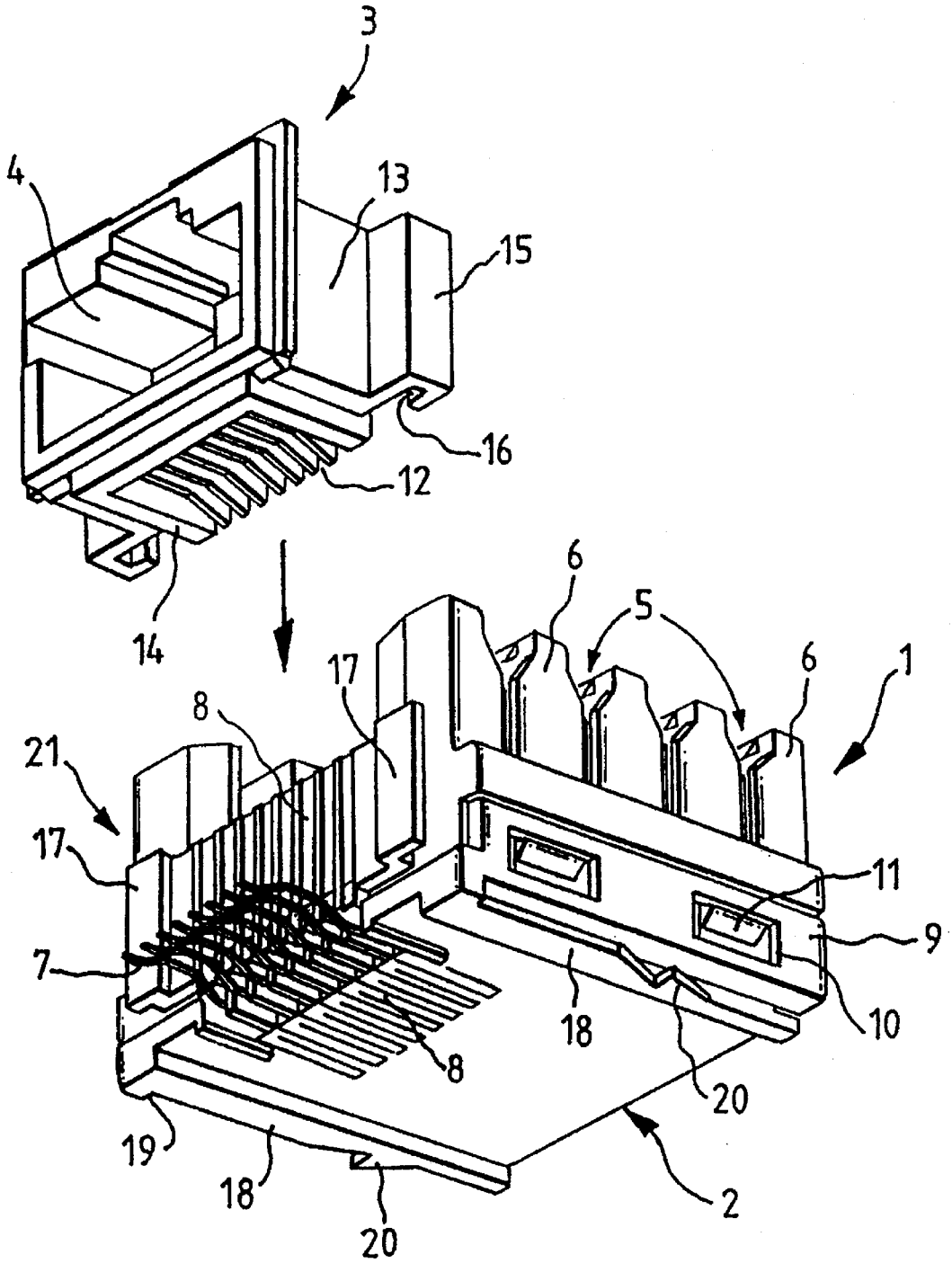
FIG. 2 is a perspective view of the plug connector of FIG. 1 with a separate plug chamber portion, prior to plugging it onto the upper housing portion.
Figure 4:
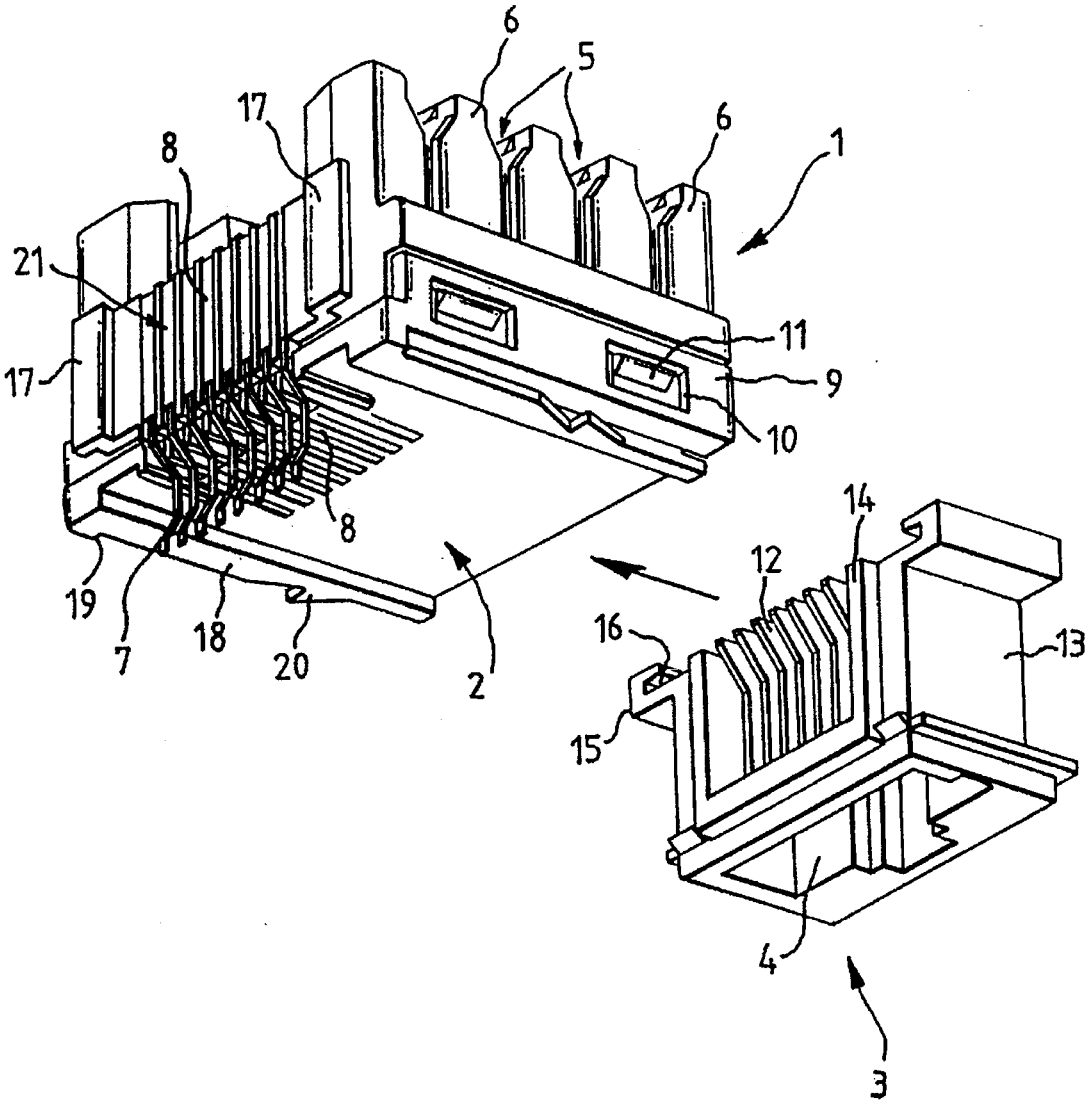
FIG. 4 is a perspective view of the plug connector of FIG. 3 with the separate plug chamber portion prior to plugging it onto the rear side of the lower housing portion.

The electrical plug connector comprises an upper housing portion 1, a lower housing portion 2 and a plug chamber portion 3 with the plug chamber 4 for the insertion of a not shown RJ plug. Upper housing portion 1, lower housing portion 2 and plug chamber portion 3 are made of plastic and have been injection molded. The upper housing portion 1 is rectangular, in a top view, and comprises on its top side two parallel rows of five clamping slots 5 each, which are disposed between six column-type elevations 6. Between the two rows of elevations 6 is provided a chamber-type depression not shown in detail in the figures. In the individual clamping slots 5 is one metal insulation displacement contact element each, which is not shown in detail and which can be wired with not shown connection wires from above. The not shown insulation displacement contact elements are connected at their inner ends with contact strips 7 projecting from the front side 21 of the upper housing portion 1, as is shown in FIGS. 2 and 4. For fixing the position of the contact strips 7, parallel grooves 8 are provided on the forward front side of the upper housing portion 1. This design of the upper housing portion 1, of the insulation displacement contact elements and of the contact strips 7 is illustrated and described in more detail in the EP 0 445 376 A1, to which reference is explicitly made. U.S. Pat. No. 5,074,804 also describes an electrical connector with RJ plug receiving region, RJ contact strips and insulation displacement contacts disposed and supported within an upper housing portion or upper body part. The upper body part includes pillars which define openings wherein the contact region of the insulation displacement contact is situated. This structure defines a wire intake direction of wires to be connected to the insulation displacement contacts. A similar arrangement is provided according to the invention including pillars or elevations 6. U.S. Pat. No. 5,074,804 is hereby incorporated by reference.

Figure 1:
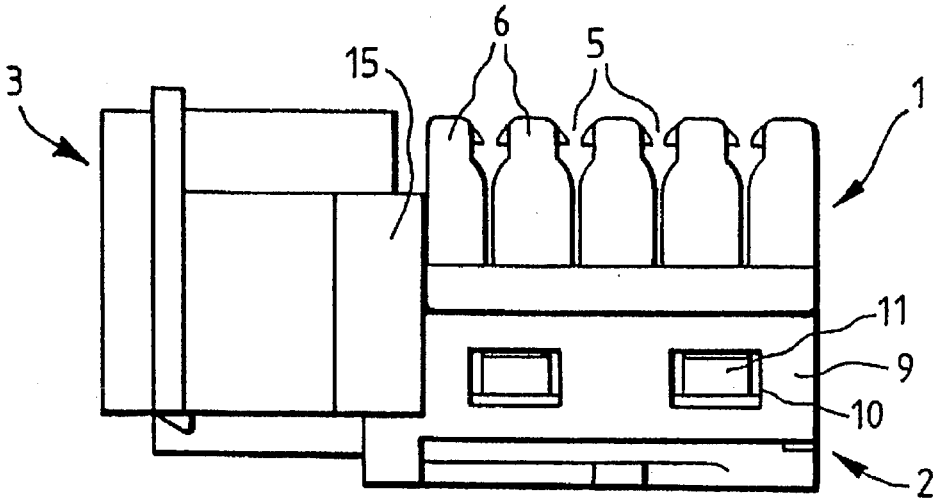
FIG. 1 is a side view of the plug connector with a plug chamber portion placed onto the front side of the upper housing portion.
Figure 3:
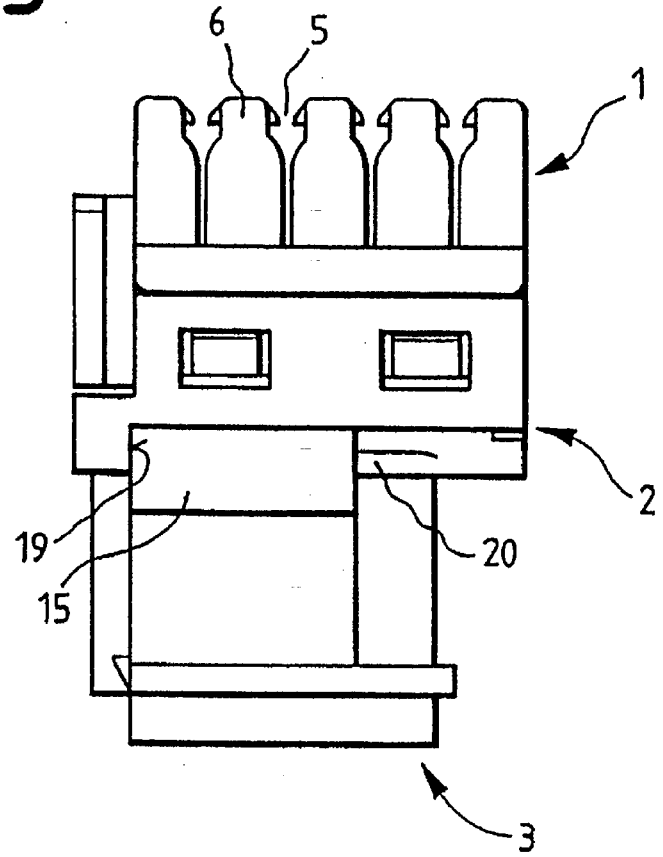
FIG. 3 is a side view of the plug connector with a plug chamber portion plugged onto the rear side of the lower housing portion.
Figure 5:
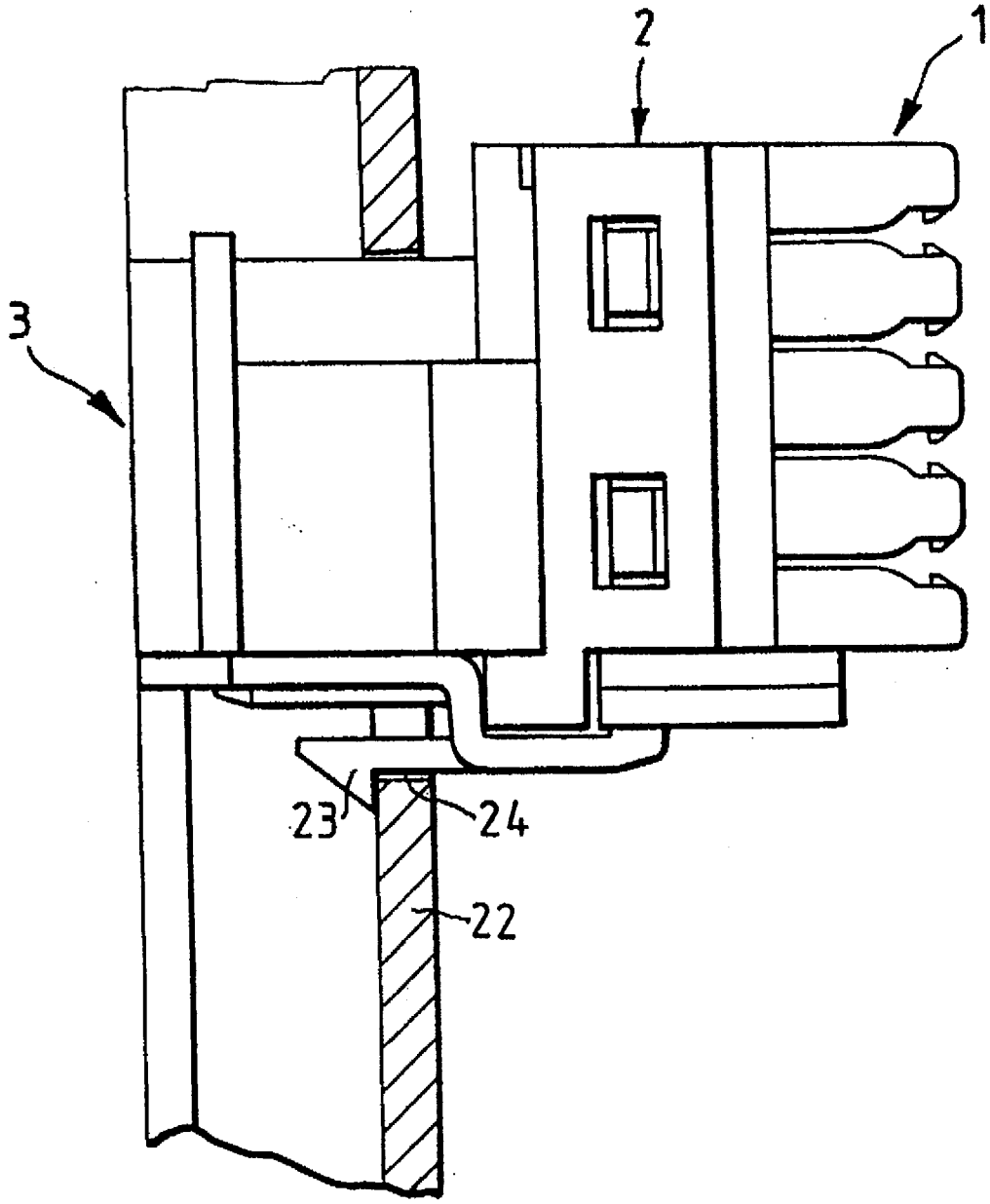
FIG. 5 is a side view of the plug connector inserted into a front panel.

The upper housing portion 1 is closed at its bottom side by the lower housing portion 2, which is formed of a plate-type housing portion with web-type side walls 9, between which the lower border of the upper housing portion 1 is latched in. For a latch connection, through-passing portions 10 are provided in the web-type side walls 9, into which engage latch lugs 11 provided at the bottom side of the upper housing portion 1. The bottom side of the lower housing portion 2 is provided on the one side with parallel grooves 8 for receiving the contact strips 7. The plug chamber portion 3 with the plug chamber 4 is adapted as a separate housing portion, as is shown in FIGS. 2 and 4, and comprises three closed side walls 13 and a side wall 14 provided with a number of slots 12 corresponding to the number of contact strips 7 extending through the slots 12 into the plug chamber 4, when the plug chamber portion 3 has been plugged onto the upper housing portion 1 or the lower housing portion 2, respectively. For establishing a plug connection between the plug chamber portion 3 and the upper housing portion 1 or the lower housing portion 2, the plug chamber portion 3 has on the two opposite closed side walls 14 one flange-type projection 15 each, which are provided with a through-passing guide groove 16. The upper housing portion 1 comprises according to FIG. 2 on its forward front side two spaced parallel guide webs 17 engaging into the guide grooves 16 when plugging the plug chamber portion 3 onto the upper housing portion 1. As is shown in FIG. 2, the contact strips 7, made of a metal material resistant to bending, project over the front side 21 of the upper housing portion 1 and engage through the slots 12 into the plug chamber 4, in order to contact, at this location the not shown RJ plug. The latter is inserted from the forward front side of the electrical connector into the plug chamber 4 and is at a right angle to the top side of the upper housing portion 1 forming the wiring side. The lower housing portion also comprises at its bottom side two spaced parallel guide webs 18 provided with front stops 19 and rear latch lugs 20, the spacing of which corresponds approximately to the length of the guide grooves 16. The plug chamber portion 3 slid according to FIG. 4 onto the bottom side of the lower housing portion 2 can thus, as is shown in FIG. 3 in a side view, be rigidly latched with the lower housing portion 2. The plug chamber 4 is available on the side of the electrical plug connector opposite to the wiring side for insertion of a not shown RJ plug. The contact strips 7 resistant to bending are bent off for this purpose at a right angle to the bottom side of the lower housing portion 2, as is shown in FIG. 4, and engage through the slots 12 of the side wall 14 of the plug chamber portion 3 into the plug chamber 4. FIG. 5 shows that the plug chamber portion 3 is provided with a latch device 23. The plug connector can thus be inserted and locked in a receiving portion 24 of a front panel 22.

While specific embodiments of the invention have been shown and described in detail to illustrate the application of the principles of the invention, it will be understood that the invention may be embodied otherwise without departing from such principles.

What is claimed is:

1. An electrical plug connector, comprising:

an upper housing portion;

a lower housing portion;

an RJ plug chamber housing portion;

contact elements disposed in said upper housing portion;

contact strips, each contact strip connecting an end of a corresponding contact element; and latch means for connecting said plug chamber housing portion to said lower housing portion, said latch means including connection elements for connecting said plug chamber housing portion in one of at least two different positions to said lower housing portion, said contact strips being bent to be disposed in either one or the other of two different positions, to extend into a plug chamber defined by said plug chamber housing portion.

2. An electrical plug connector according to claim 1, wherein said connection elements are formed of guide webs at said lower housing portion and guide grooves at said plug chamber housing portion.

3. An electrical plug connector according to claim 1, further comprising a front panel and a latch device, said latch device being provided on said plug chamber portion for latching the electrical plug connector to said front panel.

4. An electrical plug connector, comprising:

a housing defining a plurality of clamping slots;

contact elements disposed in said housing, each of said contact elements being disposed adjacent to a corresponding one of said clamping slots;

contact strips, each of said contact strips being connected to an end of a corresponding contact element;

an RJ plug chamber housing portion defining a chamber for receiving an RJ plug; and latch means for connecting said RJ plug chamber housing to said contact element housing, said latch means including connection elements for connecting said RJ plug chamber housing in one of at least two different positions to said contact element housing, said contact strips extending from said contact elements into said plug chamber in either one or the other of said two different positions.

5. An electrical plug connector according to claim 4, wherein said two different positions include a first position adjacent to a housing wall extending parallel to said contact strips and a second position adjacent to a housing wall perpendicular to said contact strips.

* * * * *